US006600257B2

(12) United States Patent
Gaertner et al.

(10) Patent No.: US 6,600,257 B2
(45) Date of Patent: Jul. 29, 2003

(54) CATHODE RAY TUBE COMPRISING A DOPED OXIDE CATHODE

(75) Inventors: Georg Friedrich Gaertner, Aachen (DE); Detlef Raasch, Aachen (DE)

(73) Assignee: Koninklijke Philips Electronics N.V., Eindhoven (DE)

( * ) Notice: Subject to any disclaimer, the term of this patent is extended or adjusted under 35 U.S.C. 154(b) by 0 days.

(21) Appl. No.: 09/951,866

(22) Filed: Sep. 13, 2001

(65) Prior Publication Data

US 2002/0070651 A1 Jun. 13, 2002

(30) Foreign Application Priority Data

Sep. 14, 2000 (DE) ..... 100 45 406

(51) Int. Cl.[7] ..... H01J 1/142; H01J 1/14
(52) U.S. Cl. ..... 313/346 R; 313/337; 445/51
(58) Field of Search ..... 313/346 R, 346 DC, 313/337, 310, 446, 441; 445/51

(56) References Cited

U.S. PATENT DOCUMENTS 4,980,603 A * 12/1990 Kimura et al. ..... 313/346 R
6,091,189 A * 7/2000 Shinjo et al. ..... 313/346 R
6,124,666 A * 9/2000 Saito et al. ..... 313/346 R
6,222,308 B1 * 4/2001 Ozawa et al. ..... 313/346 R
6,495,949 B1 * 12/2002 Park et al. ..... 313/346 R
6,504,293 B1 * 1/2003 Koizumi et al. ..... 313/346 R

FOREIGN PATENT DOCUMENTS

EP 0482704 6/1994 ..... H01J/1/14

* cited by examiner

*Primary Examiner*—Nimeshkumar D. Patel
*Assistant Examiner*—Karabi Guharay

(57) ABSTRACT

A cathode ray tube is provided with at least one oxide cathode including a cathode carrier with a cathode base of a cathode metal and a cathode coating of an electron-emitting material with oxide particles. The oxide particles contain an alkaline earth oxide selected from the group formed by the oxides of calcium, strontium, and barium, doped with an oxide doping in a quantity ranging from 120 to maximally 500 ppm of an oxide selected from the oxides of scandium, yttrium, lanthanum, cerium, praseodymium, neodymium, samarium, europium, gadolinium, terbium, dysprosium, holmium, erbium, thulium, ytterbium and lutetium. The electron-emitting material has an electric conductance of $3*10^{-3}\ \Omega^{-1}\ cm^{-1}$ to $12.5*10^{-3}\ \Omega^{-1}\ cm^{-1}$.

6 Claims, 1 Drawing Sheet

CATHODE RAY TUBE COMPRISING A DOPED OXIDE CATHODE

BACKGROUND AND SUMMARY

The invention relates to a cathode ray tube provided with at least one oxide cathode comprising a cathode carrier with a cathode base of a cathode metal and a cathode coating of an electron-emitting material containing an alkaline earth oxide selected from the group formed by the oxides of calcium, strontium and barium and a rare earth metal.

A cathode ray tube is composed of 4 functional groups:

electron beam generation in the electron gun, beam focusing using electrical or magnetic lenses, beam deflection to generate a raster, and luminescent screen or display screen.

The functional group relating to electron beam generation comprises an electron-emitting cathode, which generates the electron current in the cathode ray tube and which is enclosed by a control grid, for example a Wehnelt cylinder having an apertured diaphragm on the front side.

An electron-emitting cathode for a cathode ray tube generally is a punctiform, heatable oxide cathode with an electron-emitting, oxide-containing cathode coating. If the oxide cathode is heated, electrons are evaporated from the electron-emitting coating into the surrounding vacuum. If the Wehnelt cylinder is biased with respect to the cathode, then the quantity of emergent electrons and hence the beam current of the cathode ray tube can be controlled.

The quantity of electrons that can be emitted by the cathode coating depends on the work function of the electron-emitting material. Nickel, which is customarily used for the cathode base, has itself a comparatively high work function. For this reason, the metal of the cathode base is customarily coated with another material, which mainly serves to improve the electron-emitting properties of the cathode base. A characteristic feature of the electron-emitting coating materials of oxide cathodes in cathode ray tubes is that they comprise an alkaline earth metal in the form of the alkaline earth metal oxide.

To manufacture an oxide cathode, a suitably shaped sheet of a nickel alloy is coated, for example, with the carbonates of the alkaline earth metals in a binder preparation. During evacuating and baking out the cathode ray tube, the carbonates are converted to the oxides at temperatures of approximately 1000° C. After this burn-off of the cathode, said cathode already supplies a noticeable emission current which, however, is still unstable. Next, an activation process is carried out. This activation process causes the originally non-conducting ionic lattice of the alkaline earth oxides to be converted to an electronic semiconductor in that donor-type impurities are incorporated in the crystal lattice of the oxides. These impurities essentially consist of elementary alkaline earth metal, for example calcium, strontium or barium. The electron emission of the oxide cathodes is based on the impurity mechanism. Said activation process serves to provide a sufficiently large quantity of excess, elementary alkaline earth metal, which enables the oxides in the electron-emitting coating to supply the maximum emission current at a prescribed heating capacity. A substantial contribution to the activation process is made by the reduction of barium oxide to elementary barium by alloy constituents ("activators") of the nickel from the cathode base.

For the function and the service life of an oxide cathode it is important that elementary alkaline earth metal is continuously dispensed. The reason for this being that the cathode coating continuously loses alkaline earth metal during the service life of the cathode. The cathode material partly evaporates slowly as a result of the high temperature at the cathode and is partly sputtered off by the ion current in the cathode ray tube.

However, initially the elementary alkaline earth metal is continuously dispensed by reduction of the alkaline earth oxide at the cathode metal or activator metal. Said dispensation stops, however, when a thin, yet high-impedance interface of alkaline earth silicate or alkaline earth aluminate forms between the cathode base and the emitting oxide in the course of time. The service life is also influenced by the fact that the amount of activator metal in the nickel alloy of the cathode base becomes depleted in the course of time.

EP 0 482 704 A discloses an oxide cathode, the carrier of which is essentially composed of nickel and coated with a layer of an electron-emitting material comprising alkaline earth metal oxides, barium and a rare earth metal. The number of rare earth metal atoms in said electron-emitting material relative to the number of alkaline earth metal atoms being 10 to 500 ppm, said rare earth metal atoms being substantially uniformly distributed over the upper part of the layer of an electron-emitting material.

It is an object of the invention to provide a cathode ray tube, the beam current of which is uniform and remains constant for a long period of time, while said cathode ray tube can be reproducibly manufactured.

In accordance with the invention, this object is achieved by a cathode ray tube provided with at least one oxide cathode comprising a cathode carrier with a cathode base of a cathode metal and a cathode coating of an electron-emitting material with oxide particles, said oxide particles containing an alkaline earth oxide, selected from the group formed by the oxides of calcium, strontium and barium, doped with an oxide doping in a quantity ranging from 120 to maximally 500ppm of an oxide selected from the oxides of scandium, yttrium, lanthanum, cerium, praseodymium, neodymium, samarium, europium, gadolinium, terbium, dysprosium, holmium, erbium, thulium, ytterbium, and lutetium, and the electron-emitting material has an electric conductance of $3*10^{-3}\ \Omega^{-1}\ cm^{-1}$ to $12.5*10^{-3}\ \Omega^{-1}cm^{-1}$.

The invention is based on the principle that, in a cathode ray tube comprising an oxide cathode, the service life of said oxide cathode is extended if the electrical conductance of the cathode coating is adapted to the operating point of the average direct current load on the cathode.

A cathode ray tube comprising such an oxide cathode has a uniform beam current for a long period of time because said controlled conductance of the cathode coating enables both excessive heating and cooling of the oxide cathode during operation of the cathode ray tube to be precluded. By virtue thereof, the operating temperature in the oxide cathode is optimal. As a result, also the reaction rate at which elementary barium is formed is optimal.

As barium is dispensed continuously, depletion of the electron emission, as known from the oxide cathodes according to the prior art, is precluded. Substantially higher beam current densities can be obtained without adversely affecting the service life of the cathode. This can also be used to draw the necessary electron beam currents from smaller cathode regions. The spot size of the hot spot determines the beam focusing quality on the display screen. The picture definition is increased throughout the screen. As, in addition, the cathodes age more slowly, picture brightness and picture definition can be maintained at a high level throughout the service life of the tube. Both the resolution and the brightness of the CRT are improved or, alternatively, when the brightness and the resolution remain unchanged, the operating temperature of the cathode can be reduced.

Within the scope of the invention it is preferred that the quantity of oxide doped is 240 ppm.

In comparison with the prior art, particularly advantageous effects are obtained by the invention if the oxide doping consists of $Y_2O_3$. As a result, the barium emission becomes more uniform both locally and in time. Oxide cathodes are obtained having a higher direct current loading capability and a longer service life.

It may be preferred that the oxide doping contains a sesquioxide selected from the sesquioxides of lanthanum, neodymium, samarium, cerium, praseodymium, gadolinium, terbium, dysprosium and holmium.

It is particularly preferred that the oxide doping comprises a sesquioxide selected from the sesquioxides of lanthanum, cerium, praseodymium and neodymium. In this type of cathode, the emphasis is placed on the insensitivity to poisoning, particularly oxygen poisoning. This type of cathode exhibits a uniform emission and can be reproducibly manufactured.

The invention also relates to an oxide cathode comprising a cathode carrier with a cathode base of a cathode metal and a cathode coating of an electron-emitting material with oxide particles, said oxide particles containing an alkaline earth oxide, selected from the group formed by the oxides of calcium, strontium and barium, doped with an oxide doping in a quantity from 120 to maximally 500 ppm of an oxide selected from the oxides of scandium, yttrium, lanthanum, cerium, praseodymium, neodymium, samarium, europium, gadolinium, terbium, dysprosium, holmium, erbium, thulium, ytterbium and lutetium, and the electron-emitting material has an electrical conductance of $3*10^{-3}\Omega^{-1}$ $cm^{-1}$ to $12.5*10^{-3}\Omega^{-1}$ $cm^{-1}$.

These and other aspects of the invention will be apparent from and elucidated with reference to an embodiment described hereinafter.

BRIEF DESCRIPTION OF THE DRAWINGS

In the drawing:

The FIGURE is a diagrammatic cross-sectional view of an embodiment of the cathode in accordance with the invention.

DETAILED DESCRIPTION

Figure 1:
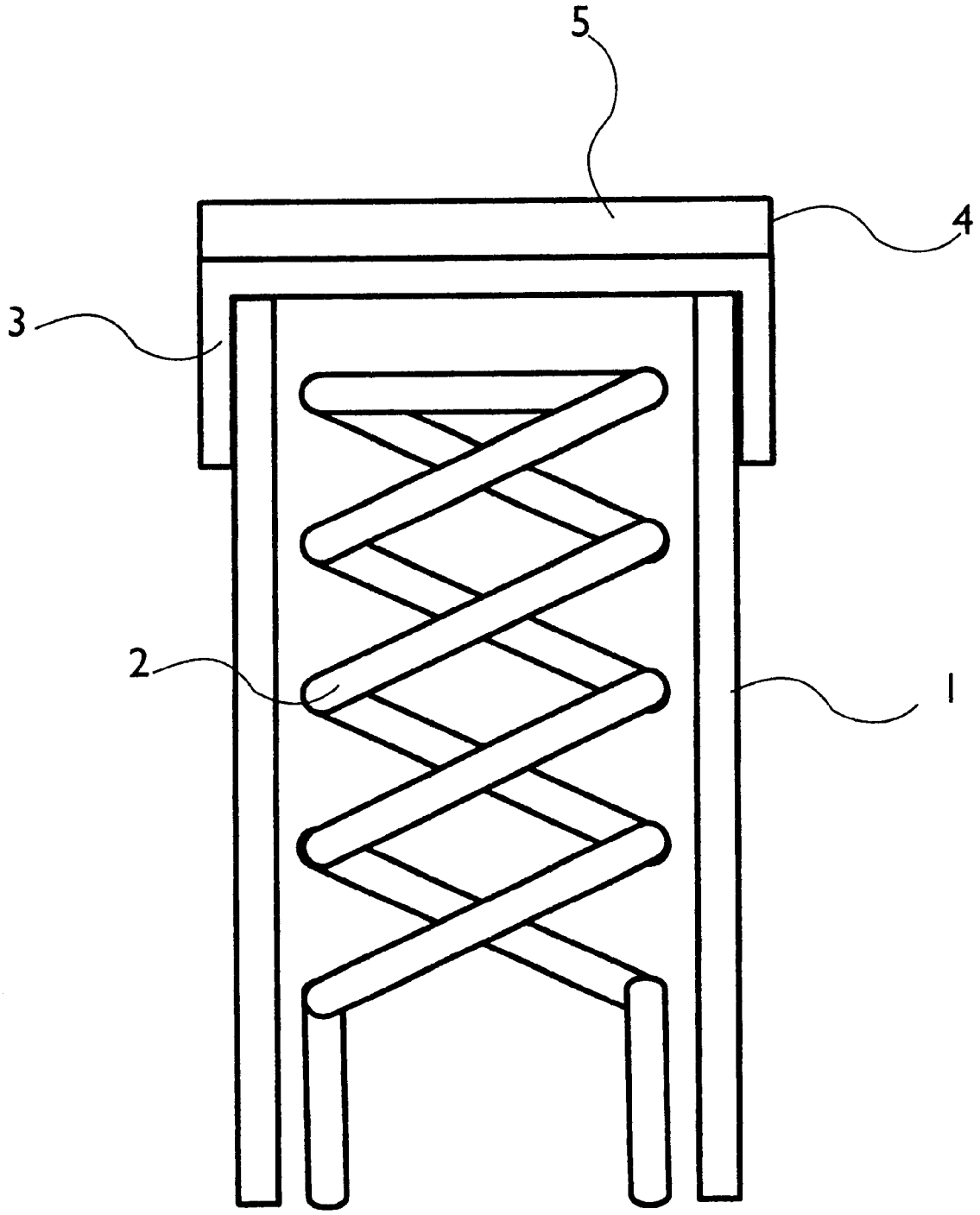

A cathode ray tube comprises an electron beam-generating system which customarily includes an arrangement of one or more oxide cathodes.

An oxide cathode in accordance with the invention comprises a cathode carrier with a cathode base and a cathode coating. The cathode carrier includes the heater and the base for the cathode body. For the cathode carrier use can be made of the constructions and materials known from the prior art.

In the embodiment of the invention shown in the FIGURE, the oxide cathode comprises a cathode carrier, i.e. a cylindrical tube 3, wherein the heating wire 4 is inserted, a top cap 2 forming the cathode base, and a cathode coating 1 which represents the actual cathode body.

Customarily, the material used for the cathode base is a nickel alloy. The nickel alloy may comprise, for example, nickel with an alloying constituent of an activator element having a reducing effect selected from the group formed by silicon, magnesium, aluminum, tungsten, molybdenum, manganese and carbon.

The cathode coating contains doped oxide particles. The main constituent of the electron-emitting material is an alkaline earth oxide, preferably barium oxide, in conjunction with calcium oxide or/and strontium oxide. They are used as a physical mixture of alkaline earth oxides or as binary or ternary mixed crystals of the alkaline earth metal oxides. Preferably use is made of a ternary alkaline earth mixed crystal oxide of barium oxide, strontium oxide and calcium oxide or a binary mixture of barium oxide and calcium oxide.

The alkaline earth oxide further comprises a doping of an oxide selected from the oxides of scandium, yttrium, lanthanum, cerium, praseodymium, neodymium, samarium, europium, gadolinium, terbium, dysprosium, holmium, erbium, thulium, ytterbium and lutetium in a quantity ranging from 120 to maximally 500 ppm. The ions of said rare earth metals occupy lattice sites or interstitial lattice sites in the crystal lattice of the alkaline earth metal oxides.

Preferably, use is made of the barium oxide doping with trivalent ions selected from the group formed by lanthanum (III) ions, neodymium(III) ions and samarium(III) ions, because their ion radii of>93 pm are comparable to those of the bivalent barium having an ion radius of 135 pm. These trivalent ions may occupy the lattice sites of barium, and the doping of the barium oxide lattice takes place without substantial lattice deformations.

The electron-emitting coating of the oxide cathode in accordance with the invention is characterized by its electrical conductance which, in the temperature range corresponding to the customary conditions in a cathode ray tube, ranges from $3*10^{-3}$ $\Omega^{-1}$ $cm^{-1}$ to $12.5*10^{-3}$ $\Omega^{-1}$ $cm^{-1}$. By virtue of said controlled conductance of the cathode, overheating or underheating, which adversely affect the service life, is precluded.

To manufacture the raw mixture for the cathode coating, the carbonates of the alkaline earth metals calcium, strontium and barium are ground and mixed in the proper weight ratio with each other and with a starting compound for the oxide of the rare earth metals scandium, yttrium, lanthanum, cerium, praseodymium, neodymium, samarium, europium, gadolinium, terbium, dysprosium, holmium, erbium, thulium, ytterbium and lutetium. As the starting compounds for the oxides of the rare earth metals use is preferably made of the rare earth metal nitrates or rare earth metal hydroxides.

The weight ratio of calcium carbonate: strontium carbonate:barium carbonate is typically 1:1.25:6 or 1:12:22 or 1:1.5:2.5 or 1:4:6.

The raw mixture may additionally be mixed with a binder preparation. Said binder preparation may comprise water, ethanol, ethylnitrate, ethylacetate or diethylacetate as the solvent.

Said raw mixture for the cathode coating is subsequently applied to the carrier by brushing, dip coating, cataphoretic deposition or spraying. The cathode thus coated is placed in the cathode ray tube. The cathode is formed when the cathode ray tube is being evacuated. By heating to a temperature in the range from approximately 650 to 1100° C., the alkaline earth carbonates are converted to alkaline earth oxides thereby releasing CO and $CO_2$, after which said alkaline earth oxides form a porous sintered body. An important factor in this conversion process is the crystallographic change caused by mixed crystal formation, which is a prerequisite for a good oxide cathode. After this cathode "burn-off", an activation process is carried out which serves to supply excess elementary alkaline earth metal which is included in the oxides. Said excess alkaline earth metal is formed by reduction of alkaline earth metal oxide. In the actual reduction activation process, the alkaline earth oxide is reduced by the released CO or activator metal from the cathode base. In addition, a current-activation process takes place, which is responsible for generating the required free alkaline earth metal by electrolytic processes at elevated temperatures.

EXAMPLE 1

As shown in the FIGURE, a cathode for a cathode ray tube in accordance with a first embodiment of the invention comprises a cap-shaped cathode base composed of an alloy of nickel with 0.03 wt. % Mg, 0.02 wt. % Al and 1.0 wt. % W. The cathode base is situated at the upper end of a cylindrical cathode carrier (bushing) wherein the heater is mounted.

The cathode is provided with a cathode coating on the upper side of the cathode base. To form the cathode coating, the cathode base is cleaned first. Subsequently, powder of different starting compounds for the oxides is suspended in a solution of ethanol, butylacetate and nitrocellulose.

The powder with the starting compounds for the oxides consists of, for example, barium-strontium-calcium-carbonate in a weight ratio of 1:1.25:6 and 240 ppm yttrium oxide.

This suspension is sprayed onto the cathode base. The layer is formed at a temperature of 10,000° C. in order to bring about alloying and diffusion between the cathode metal of the metal base and the metal particles.

The oxide cathode thus formed has a conductance of $6*10^{-3}\ \Omega^{-1}\ cm^{-1}$, a direct current loading capability of 3.5 $A/cm^2$ at a service life of 20,000 hours and an anode internal pressure of $2*10^{-9}$ bar.

What is claimed is:

1. A cathode ray tube provided with at least one oxide cathode comprising a cathode carrier with a cathode base of a cathode metal and a cathode coating of an electron-emitting material with oxide particles, said oxide particles containing an alkaline earth oxide, selected from the group formed by the oxides of calcium, strontium and barium, doped with an oxide doping in a quantity ranging from 120 to maximally 500 ppm of an oxide selected from the oxides of scandium, yttrium, lanthanum, cerium, praseodymium, neodymium, samarium, europium, gadolinium, terbium, dysprosium, holmium, erbium, thulium, ytterbium, and lutetium, and the electron-emitting material has an electric conductance of 3*10−3 Ω−1 cm−1 to 12.5*10−3 Ω−1 cm−1.

2. A cathode ray tube as claimed in claim 1, characterized in that the quantity of oxide doped is 240 ppm.

3. A cathode ray tube as claimed in claim 1, characterized in that the oxide doping consists of Y203.

4. A cathode ray tube as claimed in claim 1, characterized in that the oxide doping contains a sesquioxide selected from the sesquioxides of lanthanum, neodymium, samarium, cerium, praseodymium, gadolinium, terbium, dysprosium and holmium.

5. A cathode ray tube as claimed in claim 1, characterized in that the oxide doping comprises a sesquioxide selected from the sesquioxides of lanthanum, cerium, praseodymium and neodymium.

6. An oxide cathode comprising a cathode carrier with a cathode base of a cathode metal and a cathode coating of an electron-emitting material with oxide particles, said oxide particles containing an alkaline earth oxide, selected from the group formed by the oxides of calcium, strontium and barium, doped with an oxide doping in a quantity from 120 to maximally 500 ppm of an oxide selected from the oxides of scandium, yttrium, lanthanum, cerium, praseodymium, neodymium, samarium, europium, gadolinium, terbium, dysprosium, holmium, erbium, thulium, ytterbium, and lutetium, and the electron-emitting material has an electrical conductance of 3*10−3 Ω−1 cm−1 to 12.5*10−3 Ω−1 cm−1.

* * * * *